United States Patent [19]

Marshall

[11] Patent Number: 4,608,067

[45] Date of Patent: Aug. 26, 1986

[54] PERMANENT GAS REFRIGERATION METHOD

[75] Inventor: John Marshall, Ascot, England

[73] Assignee: The BOC Group, plc, Surrey, England

[21] Appl. No.: 636,954

[22] Filed: Aug. 2, 1984

[30] Foreign Application Priority Data

Aug. 4, 1983 [GB] United Kingdom ..... 8321073

[51] Int. Cl.[4] ..... F25J 1/00; F25J 1/02

[52] U.S. Cl. ..... 62/9; 62/38; 62/40

[58] Field of Search ..... 62/9, 38, 40, 36

[56] References Cited

U.S. PATENT DOCUMENTS

| | | | |
|---|---|---|---|
| 3,194,025 | 7/1965 | Grossmann | 62/9 |
| 3,358,460 | 12/1967 | Smith et al. | 62/9 |
| 3,677,019 | 7/1972 | Olszewski | 62/9 |
| 4,267,701 | 5/1981 | Toscano | 62/9 |

*Primary Examiner*—S. Leon Bashore

*Assistant Examiner*—Andrew J. Anderson

*Attorney, Agent, or Firm*—Larry R. Cassett; Chris P. Konkol

[57] ABSTRACT

In cooling a permanent gas stream (e.g. of nitrogen) at elevated pressure to below its critical temperature (e.g. in a process for the liquefaction of the permanent gas), the stream is heat exchanged with a main stream of working fluid (typically also nitrogen) that has been work-expanded in expansion turbine. The refrigeration provided by this stream is supplemented by that provided by at least two supplementary streams of work expanded working fluid. The temperatures at which the supplementary streams are introduced into heat exchange relationship with the permanent gas stream are in a defined range extending from 5° K. above the point at which the rate of change of the heat capacity (at constant pressure) of the gas per standard cubic meter increases by about 1% per Kelvin as the gas is cooled to 5° K. below the point at which the rate of change with temperature of the heat capacity (at constant pressure) of the gas per standard cubic meter is at a maximum.

11 Claims, 4 Drawing Figures

PERMANENT GAS REFRIGERATION METHOD

BACKGROUND TO THE INVENTION

This invention relates to a method of and apparatus for refrigerating a permanent gas. It is particularly but not exclusively concerned with cooling a relatively high pressure stream of a permanent gas to its critical temperature or below by heat exchange with relatively low pressure working fluid and is particularly applicable to the liquefaction of permanent gases.

A permanent gas has the property of not being able to be liquefied solely by increasing the pressure of the gas. Cooling of the gas at pressure is necessary so as to reach a temperature at which the gas can exist in equilibrium with its liquid state.

Conventional processes for liquefying a permanent gas or cooling it to below the critical point typically require the gas to be compressed (unless it is already available at a suitably elevated pressure, generally a pressure above the critical pressure) and heat exchanged in one or more heat exchangers against a relatively low pressure stream of working fluid. At least part of such stream of working fluid may be formed by compressing the working fluid, cooling it, typically in the aforesaid heat exchanger or exchangers, and then expanding it with the performance of external work ('work expansion'). The working fluid may itself be taken from the high pressure stream of permanent gas or the permanent gas may be kept separate from the working fluid. In the latter example, the working fluid may have the same composition as the permanent gas, or may have a different composition therefrom.

A graph of enthalpy per standard cubic meter of gas plotted against temperature for a permanent gas (herein after called an enthalpy-temperature or temperature-enthalpy curve) is shown in FIG. 1 of the accompanying drawings. Merely by way of example, the gas selected is nitrogen at a pressure of 50 atmospheres. The enthalpy-temperature curve runs from point A to point E. Point A is, say, at a temperature at which refrigeration of the gas may commence. Point E is at the temperature at which the gas has become an undercooled liquid. Starting at Point A and descending the curve, its first section is section A-B in which the gas approximates in behaviour to an ideal gas. Then there is a section B-C. In this section the behaviour of the gas deviates from that of an ideal gas and begins to assume some of the properties of a liquid. We call this section B-C the gaseous transitional section. The final section is section C-D-E. In this section the transformation from the gaseous to the liquid phase takes place and is completed.

As will be appreciated below, the section B-C of the curve is of key importance to our invention. The point B occurs where the rate of change in the slope of the curve becomes more pronounced. The slope of the curve at any temperature is the heat capacity (at constant pressure) of the gas per standard cubic meter at that temperature. We define point B as the point where the rate of change in the value of the heat capacity (at constant pressure) of the gas per standard cubic meter increases by about 1% per Kelvin as the gas is cooled. The point B defines the upper temperature limit of the gaseous transitional section.

The point C defines the lower temperature limit of the gaseous transitional section. Point C is at the temperature at which the rate of change with temperature of the heat capacity (at constant pressure) of the gas per standard cubic meter is at a maximum. If the gas to be refrigerated is at a pressure below the critical pressure the point C lies at the saturation temperature of the liquefied gas and is the point at which the gas begins to liquefy as it is cooled. For gases at pressures above the critical pressure, point C is by definition at a higher temperature than the critical temperature.

In FIG. 2 of the accompanying drawings, we identify the points B and C on a number of enthalpy-temperature curves for nitrogen at different pressures above and below the critical pressure.

In practice, at any given enthalpy value, there is a given temperature of the gas being cooled dependent solely on pressure. At each point a lower temperature is necessary in the working fluid. This temperature can be plotted on the temperature-enthalpy graph. It has been considered desirable to try to match the two temperature-enthalpy curves as closely as possible so as to minimize the area defined between the two curves. For example, in U.S. patent specification No. 3,358,460 the discrepancy between the two curves is identified as leading to the consumption of substantial amounts of power, making the refrigeration system inefficient. There is thus a disclosure of approximating the shape of the refrigerant curve to that of the permanent gas curve by causing components of the refrigerant stream to undergo a plurality of work expansion stages with intervening reheating. There is no substantive discussion in the U.S. patent specification of the theory of where best to deploy the work-expanded refrigerant. However, if FIGS. 2 and 3 of U.S. patent specification No. 3,358,460 are compared with one another, it can be seen that the bulk of the area between the cooling and heating curves of FIG. 2 comes well below the point where there is a maximum rate of change in the heat capacity (at constant pressure) per standard cubic meter (see our Figure for where this point lies) and accordingly both the work-expanded refrigerant streams are shown in FIG. 3 of the U.S. patent as being brought into heat exchange relationship with the stream being cooled at temperatures of the stream being cooled well below this point.

DESCRIPTION OF THE INVENTION

Our invention is based on the unique appreciation that in order to optimise power consumption when refrigerating a permanent gas it is necessary to supplement the main working fluid stream with at least two other work-expanded working fluid streams introduced into the heat exchange system at temperatures of the permanent gas stream on the gaseous transitional section of the temperature-enthalpy curve of the permanent gas stream or within 5° K. beyond either end of such section so as to match the temperature curve of the working fluid being heated more closely to that of the permanent gas stream being cooled along the gaseous transitional section.

Accordingly, the present invention provides a method of refrigerating a permanent gas by heat exchanging a stream of said gas at a relatively high pressure with a main stream of work-expanded working fluid flowing counter to said high pressure stream, and thereby reducing the temperature of said high pressure stream to its critical temperature or a temperature therebelow, wherein the said main stream is supplemented by at least two work expanded streams of working fluid introduced into heat exchange relationship with the permanent gas stream at temperatures of the permanent gas stream on the gaseous transitional section of the temperature-enthalpy curve of the permanent gas stream or within 5° K. beyond either end of such section, whereby to match the temperature of the working fluid as it is heated more closely to that of the permanent gas stream as it is cooled along the said gaseous transitional section.

The present invention also provides apparatus for performing the above-defined method comprising at least one heat exchanger defining heat exchange passages for heat exchanging a stream of permanent gas at relatively high pressure with a counterflowing relatively low pressure main stream of work-expanded working fluid and thereby to reduce the temperature of said high pressure stream to its critical temperature or a temperature therebelow, and at least one work-expansion means for providing said main stream of working fluid, and at least two supplementary work expansion means for introducing at least two work-expanded supplementary streams of working fluid into heat exchange relationship with the permanent gas stream at temperatures of the permanent gas stream on the gaseous transitional section of the temperature-enthalpy curve of the permanent gas stream or within 5° K. beyond either end of such section, whereby to match the temperature profile of the working fluid(s) more closely to that of the permanent gas in the said gaseous transitional section.

We believe that the method and apparatus according to the invention offer a saving of up to 6% of the power required to run a conventional refrigeration process for liquefying a permanent gas (the conventional process employing only one work-expansion engine or turbine and that to form at least part of the main working fluid stream). Moreover, we believe that the method and apparatus according to the invention offers a power saving over methods outside the scope of the invention that use an equal number of work-expansion stages.

Preferably at least one of the said supplementary streams of working fluid is introduced into heat exchange relationship with the permanent gas stream at a temperature of the permanent gas stream within plus or minus 5° K. of the lower limit (i.e. point C) of the gaseous transitional section and typically within plus or minus 2° K. of the lower limit.

We generally prefer not to use a work-expanded stream other than the main work-expanded stream to refrigerate the permanent gas stream at its temperatures more than 5° K. below the lower limit of the gaseous transitional section. Where four work-expanded working fluid streams are employed, preferably three are introduced into heat exchange relationship with the temperatures of the permanent gas stream on the gaseous transitional section or within 5° K. beyond either limit of that section.

Moreover, an external liquid refrigerant for example Freon (RTM) may be used to provide refrigeration for the permanent gas stream down to 210° K. or below.

Preferably, liquefied permanent gas is collected as the product of the method and apparatus according to the invention.

The permanent gas may, for example, be nitrogen, oxygen, fluorine, neon, argon, methane, ethane, ethylene, carbon monoxide, or a mixture of any such gases. The invention is particularly suited to the liquefaction of nitrogen, oxygen, methane and carbon monoxide.

The pressure at which the permanent gas stream is supplied to the heat exchange means is typically but not necessarily above the critical pressure of the permanent gas and may for example be 40 atmospheres.

All or any number (e.g. at least one) of the said supplementary working fluid streams may be introduced into the main working fluid stream and hence returned typically to the warm end of the heat exchange means with the main refrigerant stream. It is of course possible to pass one or more of the said supplementary working fluid streams through the heat exchange means parallel to and cocurrently with the main working fluid stream.

Typically, the main working fluid stream is formed in part by compressing the working fluid, passing it through the heat exchange means from the warm end to near the cold end thereof, and then work-expanding the working fluid. The work-expanded fluid, after passage through the heat exchange system, may be returned to the compressor. Some or all of the work-expanded supplementary working fluid streams may each flow through a circuit similar to that employed to form the main working fluid stream. In some embodiments of the invention, however, one of the work-expanded working fluid streams is withdrawn from the heat exchange means at an intermediate location and is work-expanded to a lower pressure to form another supplementary working fluid stream which is then reheated and typically returned to its compressor with the main working fluid stream.

The working fluid streams may be of a permanent gas and may be of the same composition as one another or of different composition and may also have the same composition as the said permanent gas stream.

The method and apparatus according to the present invention will now be described by way of example with reference to the accompanying drawings, in which.

Figure 1:
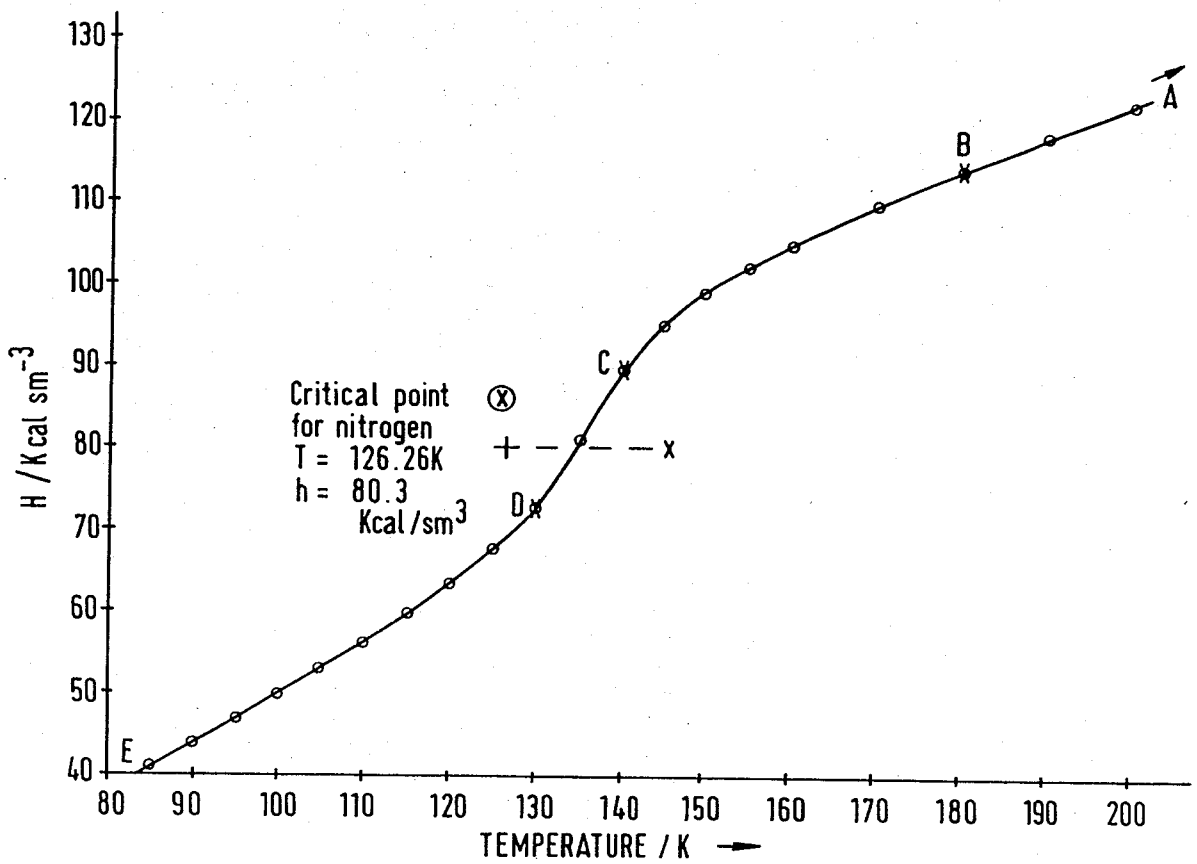
FIG. 1 is a graph of enthalpy per standard cubic meter of gas against temperature for nitrogen at a pressure of 50 bars.
Figure 2:
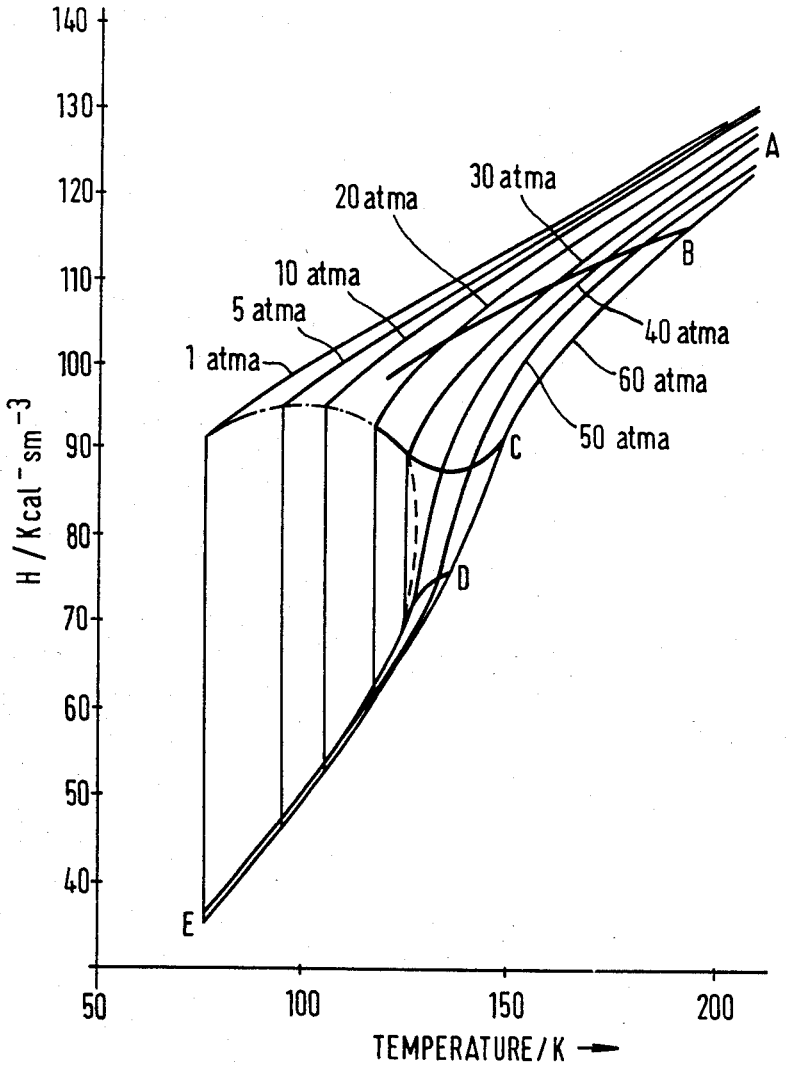
FIG. 2 shows a family of graphs of enthalpy per standard cubic meter of gas against temperature for nitrogen at various different pressures.

FIGS. 1 and 2 have been described above and will not be described further.

As has been mentioned above the use of at least two work-expanded working fluid streams at permanent gas temperatures in the gaseous transitional section of the temperature-enthalpy curve is important to the invention. Although the limits of this section have been defined above in general terms with reference to FIG. 1, the precise limits of this section can be better appreciated with reference to Table 1 below, which is a table showing H, the enthalpy per standard cubic meter of nitrogen at a pressure of 50 atmospheres, and its change with temperature (Delta H) between temperatures of 130° K., a temperature below the lower temperature limit of the gaseous transitional section and 300° K., a temperature above the upper temperature limit of the gaseous transitional section. The relatively large rate of change of Delta H within this section is to be contrasted with the relatively small rate of change of Delta H outside this section.

TABLE 1

| Position of Points B and C | T/K | H/Kcal $Sm^{-3}$ | Delta $H^1$/Kcal $Sm^{-3}K^{-1}$ |
|---|---|---|---|
| C | 130 | 72.95 | |
| | | | 1.654 |
| | 135 | 81.22 | |
| | | | 1.650 |
| B | 140 | 89.47 | |
| | | | 1.108 |
| | 145 | 95.01 | |
| | | | 0.756 |
| | 150 | 98.79 | |
| | | | 0.664 |
| | 155 | 102.11 | |
| | | | 0.556 |
| | 160 | 104.89 | |
| | | | 0.493 |
| | 170 | 190.82 | |
| | | | 0.442 |
| | 180 | 114.24 | |
| | | | 0.403 |
| | 190 | 118.27 | |
| | | | 0.382 |
| | 200 | 122.09 | |
| | | | 0.366 |
| | 220 | 129.28 | |
| | | | 0.343 |
| | 240 | 136.13 | |
| | | | 0.330 |
| | 260 | 142.73 | |
| | | | 0.324 |
| | 280 | 149.20 | |
| | | | 0.319 |
| | 300 | 155.57 | |
| | | | 0.315 |

1.The values quoted are mean values per Kelvin.

The plants shown in FIGS. 3 and 4 have the common feature that refrigeration for the permanent gas stream at temperatures below the gaseous transitional section is provided solely by the main working fluid stream (excluding any refrigeration provided by flash gas resulting from the valve expansion of a high pressure liquefied permanent gas stream formed in accordance with the invention).

Figure 3:
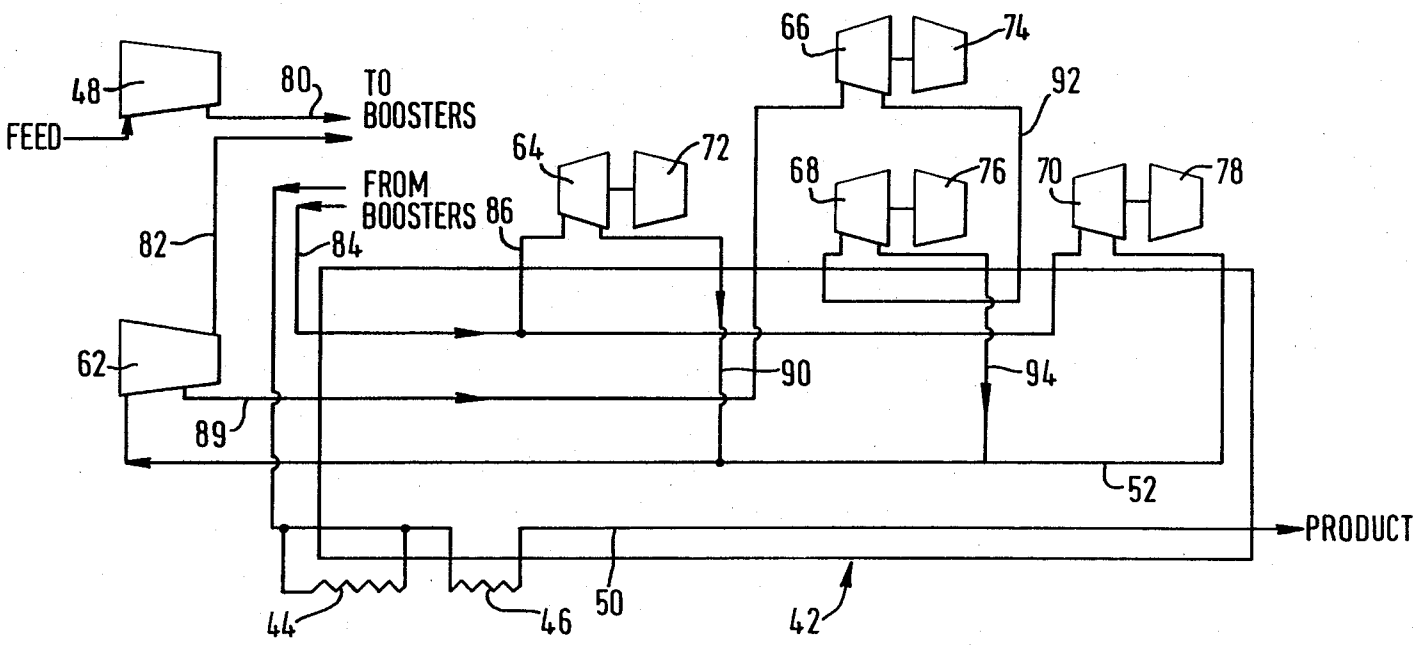
FIG. 3 is a circuit diagram illustrating a first plant according to the invention for refrigerating a permanent gas.

In the method and plant illustrated in FIG. 3 one of the supplementary work-expanded streams introduced into heat exchange relationship with the permanent gas stream at permanent gas temperatures on the gaseous transitional section of the enthalpy-temperature curve is not merged directly into the main working fluid stream. This supplementary stream is separately reheated in the heat exchange system is withdrawn therefrom at an intermediate location and is introduced into the work expansion engine or turbine used to form another supplementary stream.

The plant shown in FIG. 3 employs a main heat exchanger system 42 which is represented as one heat exchanger but may if desired comprise a plurality of heat exchangers including a first source 44 of external refrigeration and a second source 46 of external refrigeration. In addition, there is a product or permanent gas compressor 48 and a working fluid cycle compressor 62 having two stages. Further, four work expansion turbines 64, 66, 68 and 70 are employed each with an associated booster-compressor 72, 74, 76 and 78 respectively. Typically the rotors (not shown) of each expansion turbine and associated booster-compressor share a common shaft. In the plant shown in FIG. 3, the booster-compressors 72, 74, 76, and 78 are employed both in the compression of the permanent gas and the working fluid. It is immaterial which booster-compressor is used for which purpose and for this reason, and for the purpose of clarity of illustration, the flow lines showing the connections of the booster-compressor into the various flow circuits are omitted from FIG. 3.

Permanent gas to be refrigerated is drawn into the compressor 48, compressed, cooled in a water cooler (not shown) associated with the compressor 48, and passed through conduit 80 into one or more of the booster-compressors. After further water cooling, the permanent gas is returned from the boosters. The flow of the permanent gas stream is then divided, a part of it being refrigerated by the external source of refrigerant 44. The thus cooled part of the permanent gas stream is then reunited with the other part thereof at a location in the heat exchange system 42. At a point down-stream of such union, the cooled permanent gas stream 50 is subjected to further refrigeration by the external source 46 of refrigerant. After this cooling stage the stream of permanent gas 50 is at a temperature some 30° K. or more higher than the point B. It is then progressively cooled to a temperature below the critical temperature of the permanent gas and thus liquefied. Refrigeration for this purpose is provided in part by a main working fluid stream 52 that flows counter-currently to the stream 50 from the cold end to the warm end of the heat exchange system 42.

The formation of the working fluid streams is now described.

The lower pressure stage of the compressor 62 supplies compressed gaseous working fluid to selected booster-compressor(s) via conduit 82. The working fluid from the selected booster-compressor(s) is returned as stream 84 and enters the warm end of the heat exchanger system 42 and passes therethrough cocurrently with the high pressure gas stream 50. It then enters the relatively warm end of the heat exchange system 42. A part 86 of this stream 84 is withdrawn from the heat exchange system 42 at a chosen location corresponding to a point on the temperature-enthalpy curve of the permanent gas above the gaseous transitional section of the curve. The withdrawn stream 86 is expanded in expansion turbine 64 and the so formed expanded gas stream 90 is united with the main working fluid stream 52 at a permanent gas stream temperature on the gaseous transitional section of the said temperature-enthalpy curve of the stream 50 (see FIG. 1) near the point B (or at a temperature typically not more than 5° K. above point B). The remainder of the stream 84 is passed through the heat exchange system 42 and cooled to a temperature below the point C on the temperature-enthalpy curve of the permanent gas stream 50. The said remainder is then withdrawn from the heat exchange system 42 a relatively short distance upstream of the cold end thereof and work-expanded in expansion turbine 70. The so formed expanded working fluid is passed through the heat exchange system 42 as the main working fluid stream 52 counter-currently to the permanent gas stream 50.

The higher pressure stage of the compressor 62 supplies compressed refrigerant gas as stream 89 to the heat exchange system. The stream 89 passes through the heat exchange system 42 counter-currently to the main working fluid stream 52. It is withdrawn from the heat exchange 42 at a location corresponding to a point in or approaching (from above) the gaseous transitional section of the temperature-enthalpy curve of the stream 50. The withdrawn stream is then work-expanded to an intermediate pressure in expansion turbine 66 and the resultant work-expanded gas passed as a stream 92 back into the heat exchange system 42 at a permanent gas temperature corresponding to point C on the temperature-enthalpy curve of the permanent gas stream (or a temperature within not more than plus or minus 5° K. of point C). The stream 92 is reheated in the heat exchange system 42 and withdrawn therefrom at a location corresponding to a point on the temperature-enthalpy curve of the stream 50 in its gaseous transitional section. The stream 92 is then further work-expanded in expansion 68 and the resultant work-expanded stream 94 of working fluid united with the main refrigerant stream 52 at permanent gas temperature a little higher than that at which the stream 92 is introduced into the heat exchange system 42 after work expansion in the expander 66. The working fluid stream 52 is returned to the two stage compressor 62 for futher compression.

Typically the external refrigerants 44 and 46 supply in the order of 6% of the total refrigeration requirements of the process shown in FIG. 3.

If desired, the product compressor 48 may be combined with the refrigerant compressor 62 and/or the booster-compressors 72, 74, 76 and 78 in a multi-stage compression unit.

We believe the temperature profile of the working fluid streams conforms closely to that of the permanent gas stream 50 at least along the aforesaid gaseous transitional section. This result is mainly achieved as a consequence of the use of the work-expanded working fluid refrigerant streams 90, 92 and 94 to supplement the main working fluid refrigerant stream 52. So far as the objective of optimising the power consumption of the process is concerned there is no benefit to be gained by designing the configuration of work expansion to reduce the temperature discrepancy between the two curves below the critical temperature.

The plant referred to in FIG. 4 of the accompanying drawings is generally similar to FIG. 3, and only differences between the two plants and their operation shall be described below. The plant shown in FIG. 4 employs only three work-expanders (64, 66 and 70) as aforesaid (and therefore only three associated booster-compressors (72, 74 and 78). The expander 64 returns the supplementary stream 90 to the main working fluid stream 52 at a permanent gas temperature in the gaseous transitional section of the temperature section of the temperature-enthalpy curve. The expander 68 returns the supplementary stream 92 not to another expander but directly to the main working fluid stream at a permanent gas temperature at or near to the point C on the gaseous transitional section of the enthalpy-temperature curve of the permanent gas. As a result, we believe the temperature curve or profile of the working fluid streams conforms closely to the temperature-enthalpy profile of the permanent gas stream at temperatures on the gaseous transitional section of said curve, which is of vital importance to the objective of optimising power consumption.

Figure 4:
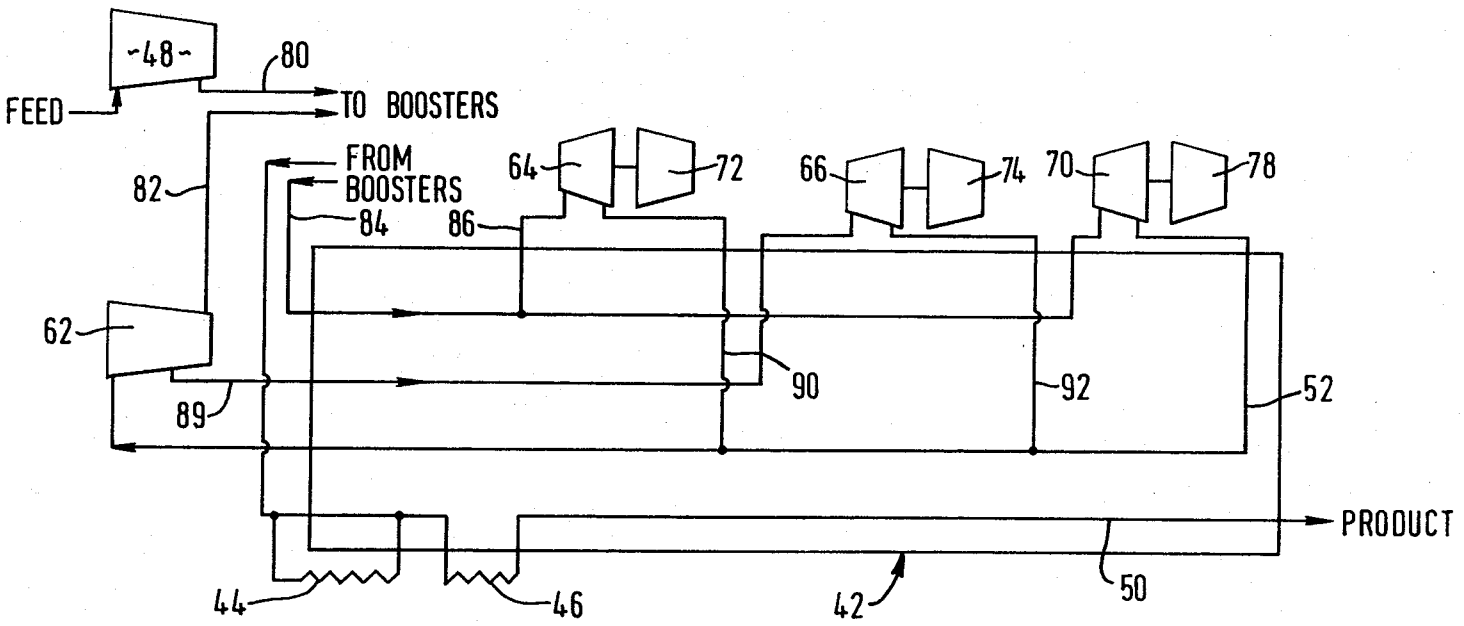
FIG. 4 is a circuit diagram illustrating a second plant according to the present invention for regrigerating a permanent gas.

Typically, in the plants shown in FIG. 3 and 4, after completion of the cooling, the resultant product liquefied permanent gas stream is passed through one or two expansion (or throttling) valves (not shown) to form a liquid product at a pressure suitable for storage (e.g. at near to 1 atmospheres) and flash gas. The flash gas is preferably returned through the heat exchanger(s) countercurrently to the permanent gas stream and recompressed with incoming permanent gas.

I claim:

1. A method of refrigerating a permanent gas by heat exchanging a stream of said gas at a relatively high pressure with a main stream of work-expanded working fluid flowing counter to said high pressure stream, and thereby reducing the temperature of said high pressure stream to its critical temperature or a temperature therebelow, wherein the said main stream is supplemented by at least two work-expanded streams of working fluid introduced into heat exchange the permanent gas stream on the gaseous transitional section of relationship with the permanent gas stream at temperatures of the temperature-enthalpy curve of the permanent gas stream or within 5° K. beyond either end of such section, but with no work expanded stream of working fluid other than said main work expanded stream being used to refrigerate the permanent gas stream at its temperature more than 5° K. below the lower limit of the gaseous transitional section whereby the temperature of the working fluid as it is heated is more closely matched to that of the permanent gas stream as it is cooled along the said gaseous transitional section.

2. A method as claimed in claim 1, in which at least one of the said supplementary streams of working fluid is introduced into heat exchange relationship with the permanent gas stream at a temperature of the permanent gas stream within plus or minus 5° K. of the lower limit of the gaseous transitional section.

3. A method as claimed in claim 2, in which at least one of the said supplementary streams of working fluid is introduced into heat exchange relationship with the permanent gas stream at a temperature of the permanent gas stream within plus or minus 2° K. of the lower limit of the gaseous transitional section.

4. A method as claimed in claim 1, in which just three or four work-expanded working fluid streams are employed, one being the said main stream.

5. A method as claimed in claim 4, in which four work-expanded working fluid streams are employed, three being introduced into heat exchange relationship with the permanent gas stream at temperatures of the permanent gas stream on the said gaseous transitional section or within 5° K. beyond either limit of that section.

6. A method as claimed in claim 1, in which at least one of the supplementary working fluid streams is introduced into the main working fluid stream and returned to the warm end of the heat exchange system with the main working fluid stream.

7. A method as claimed in claim 6, in which some or all of the supplementary working fluid streams each flow through a circuit in which working fluid is compressed, cooled in the heat exchange means, work-expanded, reheated in the heat exchange means and returned to the compressor.

8. A method as claimed in claim 7, in which one of the supplementary working fluid streams is withdrawn from the heat exchange means at an intermediate location and is work expanded to a lower pressure to form another supplementary working fluid stream.

9. A method as claimed in claim 1, in which each working fluid is taken from permanent gas to be liquefied.

10. A method as claimed in claim 1, in which after the permanent gas has been cooled to its critical temperature or a temperature therebelow, the resultant liquefied permanent gas stream is passed through one or two expansion valves to form a liquid product at a storage pressure and flash gas.

11. A method as claimed in claim 10, in which the flash gas is heat exchanged countercurrently with the permanent gas stream.

* * * * *

UNITED STATES PATENT AND TRADEMARK OFFICE

CERTIFICATE OF CORRECTION

ATENT NO. : 4,608,067

ATED : August 26, 1986

IVENTOR(S) : John Marshall

It is certified that error appears in the above-identified patent and that said Letters Patent is hereby rrected as shown below:

olumn 8, lines 6-9 after exchange "the permanent gas stream n the gaseous transitional section of relationship with the ermanent gas streams at temperature-enthalpy" should read:

relationship with the permanent gas stream at temperatures of he permanent gas stream on the gaseous transitional section of he temperature-enthalpy"

Signed and Sealed this

Second Day of July, 1991

*Attest:*

*Attesting Officer*

HARRY F. MANBECK, JR.

*Commissioner of Patents and Trademarks*